US008776379B2

(12) United States Patent
Walters

(10) Patent No.: US 8,776,379 B2
(45) Date of Patent: Jul. 15, 2014

(54) REMOVABLE STRIP FOR PACKAGING CUTLERY AND RELATED METHODS

(75) Inventor: Richard S. Walters, Port Washington, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 291 days.

(21) Appl. No.: 13/188,533

(22) Filed: Jul. 22, 2011

(65) Prior Publication Data

US 2012/0047744 A1 Mar. 1, 2012

Related U.S. Application Data

(60) Provisional application No. 61/376,531, filed on Aug. 24, 2010.

(51) Int. Cl.
*A47J 43/28* (2006.01)
*B26B 11/00* (2006.01)

(52) U.S. Cl.
USPC ..... 30/142; 30/322; 30/123

(58) Field of Classification Search
USPC ..... 30/142, 322, 324, 329, 123
See application file for complete search history.

(56) References Cited

U.S. PATENT DOCUMENTS

| | | | |
|---|---|---|---|
| 46,832 | A | 3/1865 | Thorpe |
| 592,105 | A | 10/1897 | Barnes |
| 716,058 | A | 12/1902 | Lang et al. |
| 925,485 | A | 2/1909 | Lefler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,355,583 | A | 10/1920 | Zeidler et al. |
| 1,482,071 | A | 1/1924 | Duff et al. |
| 1,504,098 | A | 8/1924 | Cathey |
| 1,560,938 | A | 11/1925 | Lund |
| 1,767,634 | A | 6/1930 | Weiss |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

European Patent Report 06009258.2, mailed Jul. 24, 2006, five pages, Munich, Germany.

(Continued)

*Primary Examiner* — Sean Michalski
(74) *Attorney, Agent, or Firm* — William W. Letson

(57) ABSTRACT

An elongated apparatus for releasably retaining a plurality of utensils in a grouping includes an elongated base and at least one protrusion. The apparatus includes an elongated base having a longitudinal axis and at least one protrusion extending from the elongated base. The at least one protrusion is configured to be removably coupled to a handle end of a utensil such that coupling of the handle end occurs via movement of the handle end along an axis transverse to the longitudinal axis of the elongated base. Upon coupling of the handle end of the utensil to the at least one protrusion, the utensil is restricted from rotating about the longitudinal axis so long as the handle end of the utensil is coupled to the at least one protrusion.

20 Claims, 9 Drawing Sheets

(56) References Cited

U.S. PATENT DOCUMENTS 1,886,378 A 11/1932 Dearsley
2,052,505 A * 8/1936 Vetrosky ..... 99/419
2,053,828 A 9/1936 Harper
2,078,984 A 5/1937 Williamson
2,110,189 A 3/1938 Zeidler, Sr.
2,141,684 A 12/1938 Diemer
2,149,098 A 2/1939 Phinney
2,149,099 A 2/1939 Phinney et al.
2,188,573 A 1/1940 Longo
D119,760 S * 4/1940 Kopp ..... D6/572
2,207,528 A 7/1940 Witt
2,239,196 A 4/1941 Lunvik
2,268,596 A 1/1942 Jerum
2,268,873 A 1/1942 Hopkins et al.
2,340,561 A 2/1944 Renfro
2,421,782 A 6/1947 Gibbs et al.
2,427,321 A 9/1947 Casey et al.
2,472,051 A 5/1949 Testi
2,503,741 A 4/1950 Johnson
2,571,668 A 10/1951 Booth et al.
2,577,344 A 12/1951 Masure
2,635,025 A 4/1953 Ziska
2,646,874 A 7/1953 Testi
2,671,555 A 3/1954 Shnitzler
2,692,691 A 10/1954 Harriss et al.
2,752,678 A 7/1956 Welch
2,806,634 A 9/1957 Baumgartner
2,868,344 A 1/1959 Shields
2,877,926 A 3/1959 Abbe
2,880,907 A 4/1959 Mainers
2,889,076 A 6/1959 Van Schie
2,911,127 A 11/1959 Driss et al.
2,924,357 A 2/1960 Kingsley et al.
2,946,431 A 7/1960 Nissen
2,954,948 A 10/1960 Johnson
2,965,262 A 12/1960 Du Bois
3,083,879 A 4/1963 Coleman
3,095,114 A 6/1963 Tobias
3,100,842 A 8/1963 Tellefsen
3,114,475 A 12/1963 Etes
3,132,765 A 5/1964 Florendo
3,146,908 A 9/1964 Perri et al.
3,163,327 A 12/1964 Maxwell
3,180,489 A 4/1965 McGinn
3,263,860 A 8/1966 Haas
3,300,087 A 1/1967 Kuypers
3,310,271 A * 3/1967 King ..... 248/220.43
3,313,452 A 4/1967 Katz
3,334,784 A 8/1967 Morrison
3,338,471 A 8/1967 De Good
3,371,821 A 3/1968 Abood, Jr. et al.
3,407,927 A 10/1968 Jones
3,426,941 A 2/1969 Hovekamp
3,472,421 A 10/1969 Baller
3,499,538 A 3/1970 Sherard
3,558,006 A 1/1971 Redmond et al.
3,587,922 A 6/1971 Oriti
3,680,736 A 8/1972 Viessmann
3,710,535 A 1/1973 Walter
3,786,959 A 1/1974 Greb et al.
4,043,203 A 8/1977 Montesi
4,091,915 A 5/1978 Claasen
4,120,662 A 10/1978 Fosslien
4,134,519 A 1/1979 Barnett et al.
4,308,974 A 1/1982 Jones
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,610,087 A 9/1986 Mickelson et al.
4,614,004 A 9/1986 Oshida
4,662,536 A 5/1987 Powers
4,691,811 A 9/1987 Arakawa et al.
4,697,673 A 10/1987 Omata
4,715,514 A 12/1987 Vidondo
4,789,064 A 12/1988 Segal
4,835,864 A 6/1989 Tang
4,863,033 A * 9/1989 Buj ..... 206/541
D305,709 S * 1/1990 Blignaut ..... D6/468
4,896,792 A 1/1990 Marchand
4,973,037 A 11/1990 Holbrook
4,986,442 A 1/1991 Hinterreiter
4,995,154 A 2/1991 Bamber
D318,600 S 7/1991 Lillelund et al.
5,080,257 A 1/1992 Carnisio
5,127,546 A 7/1992 Chen
5,131,586 A 7/1992 Capy
5,191,997 A 3/1993 Squitieri
5,211,267 A 5/1993 Clark
5,249,705 A 10/1993 Gates
D342,648 S 12/1993 Cautereels et al.
5,269,397 A 12/1993 Kawamoto et al.
5,327,650 A 7/1994 Rojas
D351,085 S 10/1994 Schmidt
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,497,863 A 3/1996 Schmidt et al.
5,509,522 A 4/1996 Laidlaw
5,542,508 A 8/1996 Van Erden et al.
5,564,594 A 10/1996 Monfredo
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A * 6/1998 Ensign ..... 211/70.6
5,845,403 A 12/1998 Nivin
5,853,092 A * 12/1998 Goodman et al. ..... 211/70.6
5,904,250 A 5/1999 De Schutter
5,921,408 A 7/1999 Groenewold et al.
5,961,021 A 10/1999 Koike et al.
6,023,913 A 2/2000 Gray et al.
D422,431 S * 4/2000 Goins ..... D6/450
6,047,830 A 4/2000 Chang
6,085,916 A * 7/2000 Kovacevic et al. ..... 211/86.01
6,202,891 B1 3/2001 Mark
6,250,498 B1 6/2001 Lovejoy
6,298,960 B1 10/2001 Derr
6,378,729 B1 4/2002 Kodama
D458,070 S * 6/2002 Bennett et al. ..... D6/567
6,575,313 B1 * 6/2003 Chen ..... 211/70.6
6,626,633 B2 9/2003 Jendzurski et al.
6,651,841 B2 11/2003 Tsuchida
6,749,074 B1 * 6/2004 Hileman et al. ..... 211/85.7
D492,549 S 7/2004 Welch
D493,337 S 7/2004 Welch
6,763,972 B2 7/2004 Graupner
6,832,694 B2 12/2004 Goeking et al.
6,837,028 B1 1/2005 Miano et al.
6,840,353 B2 1/2005 Arisaka
6,945,427 B2 9/2005 Hieb
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
D533,034 S 12/2006 Wasserman
D536,222 S 2/2007 Heiberg et al.
7,210,279 B1 5/2007 Ahmed et al.
7,322,172 B2 1/2008 Hoffman et al.
D564,819 S * 3/2008 Fosburg et al. ..... D6/569
7,412,808 B2 8/2008 Lavi
D591,104 S 4/2009 Oakes
7,513,089 B2 4/2009 Rubin
7,516,831 B2 4/2009 Chang
7,520,247 B2 4/2009 Rutledge
7,716,842 B2 5/2010 Sumner-Trivisani et al.
7,731,899 B2 6/2010 Talmer et al.
7,856,722 B2 12/2010 Lago-Arenas

(56) References Cited

U.S. PATENT DOCUMENTS

| | | | | |
|---|---|---|---|---|
| 8,070,013 | B2 | 12/2011 | Reinsel et al. | |
| 8,152,004 | B2 | 4/2012 | Smith et al. | |
| 8,272,533 | B1 | 9/2012 | D'Amelia | |
| 8,296,957 | B2 | 10/2012 | Muehlemann | |
| 8,297,473 | B2 | 10/2012 | Smith | |
| 8,360,273 | B2 | 1/2013 | Reinsel et al. | |
| 2002/0112445 | A1 | 8/2002 | Scaduto | |
| 2003/0015824 | A1 | 1/2003 | Forbes et al. | |
| 2003/0146061 | A1 | 8/2003 | Tournier | |
| 2004/0045398 | A1 | 3/2004 | Hayashi | |
| 2004/0045860 | A1 | 3/2004 | Edgerly et al. | |
| 2004/0089670 | A1 | 5/2004 | Goeking et al. | |
| 2005/0034310 | A1* | 2/2005 | Conforti | 30/169 |
| 2005/0082307 | A1 | 4/2005 | Tucker | |
| 2005/0155229 | A1 | 7/2005 | Lee | |
| 2005/0224531 | A1* | 10/2005 | Bulovic | 223/85 |
| 2005/0252057 | A1 | 11/2005 | Lavi | |
| 2006/0000190 | A1 | 1/2006 | Behnke et al. | |
| 2006/0053638 | A1* | 3/2006 | Sumner-Trivisani et al. | 30/298.4 |
| 2006/0218795 | A1* | 10/2006 | Santa Cruz et al. | 30/147 |
| 2007/0035943 | A1 | 2/2007 | Wang | |
| 2007/0108141 | A1 | 5/2007 | Smith et al. | |
| 2007/0131705 | A1 | 6/2007 | Behravesh et al. | |
| 2007/0193968 | A1 | 8/2007 | Smith et al. | |
| 2007/0214650 | A1 | 9/2007 | Tomazini | |
| 2007/0250391 | A1* | 10/2007 | Prade et al. | 705/16 |
| 2008/0121650 | A1 | 5/2008 | Smith | |
| 2008/0128445 | A1 | 6/2008 | Huang et al. | |
| 2009/0194557 | A1 | 8/2009 | Van Deursen | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 | 9/2011 | Reinsel et al. | |
| 2011/0296693 | A1 | 12/2011 | Oakes | |
| 2012/0036724 | A1 | 2/2012 | Walters | |
| 2012/0080444 | A1 | 4/2012 | Smith et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 | 2/2013 | Oakes | |
| 2013/0152406 | A1 | 6/2013 | McFarland | |

FOREIGN PATENT DOCUMENTS

| | | | |
|---|---|---|---|
| DE | 7033238 | U1 | 11/1970 |
| DE | 7127677 | U | 11/1971 |
| DE | 3151268 | | 7/1983 |
| DE | 4139938 | | 6/1993 |
| DE | 9316566 | | 1/1994 |
| DE | 19906369 | | 2/2000 |
| DE | 202005013647 | U1 | 7/2006 |
| EP | 0856272 | A2 | 1/1999 |
| EP | 1022107 | A1 | 7/2000 |
| EP | 1217923 | B1 | 9/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| KR | 10-2009-0071515 | A | 7/2009 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/012606 | A1 | 11/2007 |
| WO | 2008/058187 | A2 | 5/2008 |
| WO | 2009137367 | A2 | 11/2009 |

OTHER PUBLICATIONS

International Search Report and Written Opinion for PCT/US07/83752, mailed Mar. 11, 2008, ten pages, European Patent Office, Munich, Germany.

Partial International Search Report for PCT/US2007/083922, mailed Jul. 8, 2008, two pages.

European Search Report for EP 08 014 387.8 mailed Nov. 11, 2008, two pages, European Patent Office, Munich, Germany.

International Search Report and Written Opinion for PCT/US2007/083922, mailed Nov. 17, 2008, 13 pages, European Patent Office, Rijswijk, Netherlands.

International Search Report and Written Opinion for PCT/US2009/059915, mailed Feb. 3, 2010, 13 pages, European Patent Office, Munich, Germany.

Office Actions for U.S. Appl. No. 11/556,808, filed Nov. 6, 2006.

Office Actions for U.S. Appl. No. 11/415,836, filed May 2, 2006.

Office Action for U.S. Appl. No. 12/349,203, filed Jan. 6, 2009.

International Search Report and Written Opinion of the International Search Authority for PCT/US2011/058767 mailed Feb. 29, 2012.

Supplementary European Search Report dated Sep. 25, 2013 for Application No. 11793088.3 (20760).

* cited by examiner

REMOVABLE STRIP FOR PACKAGING CUTLERY AND RELATED METHODS

CROSS-REFERENCE TO RELATED APPLICATION

This application claims priority to U.S. Provisional Patent Application No. 61/376,531 filed Aug. 24, 2010, the disclosure of which is incorporated herein in its entirety by this reference.

FIELD OF THE DISCLOSURE

The present disclosure relates to disposable cutlery. In particular, the present disclosure relates to a grouping of utensils including an elongated apparatus to which the utensils may be removably coupled.

BACKGROUND

Disposable cutlery may be provided as a less expensive alternative to reusable cutlery, for example, at restaurants and social gatherings where it is undesirable or cost prohibitive to clean the cutlery for reuse. However, providing disposable cutlery may present a number of potential drawbacks related to the nature in which it is dispensed.

For example, providing disposable cutlery in a loose or unpackaged fashion, such as in loose form in a receptacle containing the disposable cutlery, may result in patrons taking more cutlery than necessary, thereby increasing the cost of providing the cutlery. In addition, providing loose or unpackaged cutlery may present concerns regarding whether dispensing cutlery in such a manner is hygienic. As a result, it may be desirable to dispense disposable cutlery in a manner other than in a loose or unpackaged form.

The above-noted concerns may be addressed by dispensing disposable cutlery from dispensers configured to contain a supply of the cutlery and dispense a disposable utensil upon operation of a patron. However, loading a quantity of unsecured or loose utensils into the dispenser may be a time consuming and tedious task, thereby potentially undermining the desirability of dispensing utensils via a dispenser.

In addition, it may be desirable to provide utensils that are not prone to flipping or otherwise changing from a desired orientation during either a process of being loaded into a dispenser, or a process of being dispensed from a dispenser. For example, during dispensing of a stack of loose utensils, the utensils may have a tendency to flip or rotate within the dispenser as the stack slides within the dispenser, which may lead to jamming the dispenser, thereby potentially compromising the utility of the dispenser.

Additionally, it may be desirable to provide utensils in a form that are capable of being reliably dispensed from a dispenser in an individual fashion. Utensils that are loosely received in a dispenser may have a tendency to dispense such that more than one utensil is unintentionally dispensed by a patron. This results in compromising one of the potential advantages of dispensing utensils via a dispenser-reducing costs associated with patrons taking more utensils than necessary.

Thus, it is desirable to provide a system and method for addressing one or more of the potential drawbacks discussed above.

SUMMARY

In the following description, certain aspects and embodiments will become evident. It should be understood that the aspects and embodiments, in their broadest sense, could be practiced without having one or more features of these aspects and embodiments. Thus, it should be understood that these aspects and embodiments are merely exemplary.

One aspect of the disclosure relates to an elongated apparatus for releasably retaining a plurality of utensils in a grouping. The apparatus includes an elongated base having a longitudinal axis and at least one protrusion extending from the elongated base. The at least one protrusion is configured to be removably coupled to a handle end of a utensil such that coupling of the handle end occurs via movement of the handle end along an axis transverse to the longitudinal axis of the elongated base. Upon coupling of the handle end of the utensil to the at least one protrusion, the utensil is restricted from rotating about the longitudinal axis so long as the handle end of the utensil is coupled to the at least one protrusion, Another aspect of the disclosure relates to a grouping of a plurality of utensils. At least one of the plurality of utensils includes a functional end and a handle associated with the functional end, wherein the handle has a handle end. The grouping also includes an elongated apparatus for releasably retaining the plurality of utensils in the grouping. The elongated apparatus includes an elongated base having a longitudinal axis and at least one protrusion extending from the elongated base. The handle end of the at least one utensil is removably coupled to the apparatus via the at least one protrusion.

Yet another aspect of the disclosure relates to a method for separating a utensil from an elongated apparatus for releasably retaining a plurality of utensils. At least one of the plurality of utensils includes a functional end and a handle associated with the functional end, wherein the handle has a handle end. The handle end of the at least one utensil is removably coupled to the apparatus via the at least one protrusion. The method includes applying a force to the utensil such that the handle end of the utensil is decoupled from the elongated base.

As used herein, the term "parallel" means substantially parallel, and the term "perpendicular" means substantially perpendicular.

BRIEF DESCRIPTION OF THE DRAWINGS

The accompanying drawings, which are incorporated in and constitute a part of this description, illustrate several exemplary embodiments and together with the description, serve to explain principles of the embodiments. In the drawings.

DESCRIPTION OF EXEMPLARY EMBODIMENTS

Figure 1:
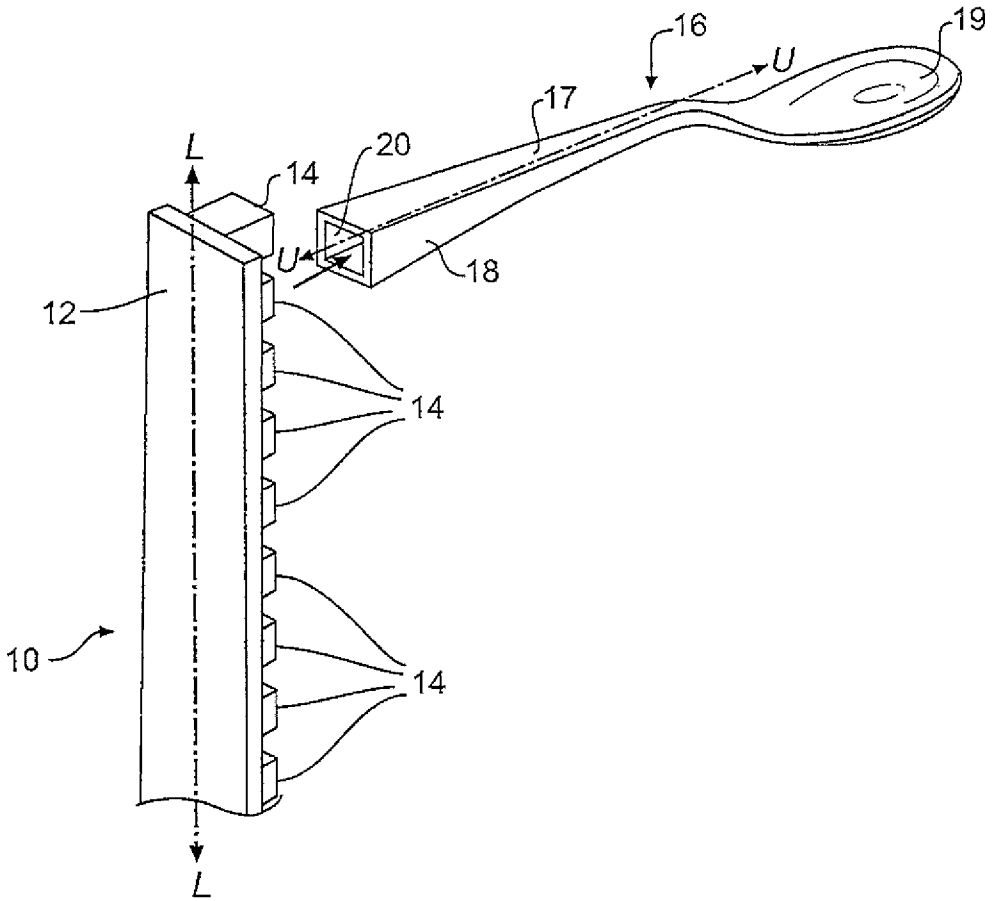
FIG. 1 is a schematic partial perspective view of an exemplary elongated apparatus and an exemplary utensil.

Reference will now be made in detail to exemplary embodiments. Wherever possible, the same reference numbers are used in the drawings and the description to refer to the same or like parts.

FIG. 1 shows a schematic partial perspective view of an exemplary elongated apparatus 10 for releasably retaining a plurality of utensils 16 in a grouping, and an exemplary utensil 16. For example, as shown in FIG. 1, exemplary elongated apparatus 10 and exemplary utensil 16 are configured to be removably coupled to one another via exemplary protrusion 14. Elongated apparatus 10 includes an elongated base 12. In some embodiments, the elongated base 12 may have a shape that is relatively thin and flat. However, it is anticipated that elongated base 12 may have any shape, such as, for example, a shape that includes ridges along one side of the elongated base 12 that may be used to maintain the positioning of the elongated base 12 within a dispenser. Elongated apparatus 10 includes a longitudinal axis L that extends along the length of elongated apparatus 10.

In some embodiments, elongated apparatus 10 may be constructed from a formable material. The formable material may include, for example, plastic, combinations of plastics, or combinations of plastics and other materials suitable for use as disposable or reusable cutlery. For example, the formable material may include one or more of polystyrene, polyethylene, and polypropylene.

As shown in FIG. 1, elongated base 12 may include at least one protrusion 14 extending from elongated base 12. While FIG. 1 shows nine protrusions 14 extending from elongated base 12, any number of protrusions 14 may extend from elongated base 12, such as, for example, 10, 15, 20, 25, 35, 50, or 100 or more protrusions 14. Protrusions 14 are configured to be removably coupled to at least one utensil 16. According to some embodiments elongated apparatus 10 may be configured to be shortened by, for example, breaking- or cutting-off a portion of the elongated apparatus 10. Such embodiments may facilitate reducing the number of utensils 16 grouped together by elongated apparatus 10.

As shown in FIG. 1, exemplary utensil 16 is a spoon. However, utensil 16 may be any type of utensil, including, for example, a spoon, a fork, a knife, and a spork. In some embodiments, utensil 16 may be constructed from a formable material. The formable material may include, for example, plastic, combinations of plastics, or combinations of plastics and other materials suitable for use as disposable or reusable cutlery. For example, the formable material may include one or more of polystyrene, polyethylene, and polypropylene.

Exemplary utensil 16 includes a handle 17, which may be utilized by a user to hold and/or manipulate utensil 16. Handle 17 includes a handle end 18. Utensil 16 also has a functional end 19, which may be configured to be used to perform a function that assists in the consumption of food, for example, cutting, piercing, and/or scooping. While handle end 18 may be a portion of handle 17, handle end 18 may also encompass all of handle 17.

As shown in FIG. 1, protrusion 14 may be configured to be removably coupled to handle end 18 of utensil 16. In order to facilitate removable coupling, protrusion 14 may be shaped to fit within a portion of handle end 18. For example, in some embodiments, such as the embodiment of FIG. 1, handle end 18 may include at least one opening 20 accessible along a utensil axis U of utensil 16, such that opening 20 is configured to receive at least one protrusion 14.

Coupling of handle end 18 to protrusion 14 may occur via movement of handle end 18 along an axis transverse to longitudinal axis L of elongated base 12. For example, in some embodiments, coupling of handle end 18 to protrusion 14 may occur via movement of handle end 18 along an axis perpendicular to longitudinal axis L. According to some embodiments, coupling may occur via movement of handle end 18 along an axis substantially parallel to longitudinal axis L. In some embodiments, upon coupling of handle end 18 to at least one protrusion 14, utensil 16 is substantially restricted from rotating about longitudinal axis L, so long as handle end 18 remains coupled to protrusion 14.

Coupling of handle end 18 to protrusion 14 may occur via movement of handle end 18 along an axis substantially parallel to utensil axis U. In some embodiments, for example, opening 20 may be located at the end of utensil 16, positioned to removably couple to protrusion 14 via movement along an axis substantially parallel to utensil axis U (see, e.g., FIG. 1). According to some embodiments, however, handle end 18 may removably couple with protrusion 14 via movement along an axis that is not substantially parallel to utensil axis U (see, e.g., FIG. 2).

Figure 2:
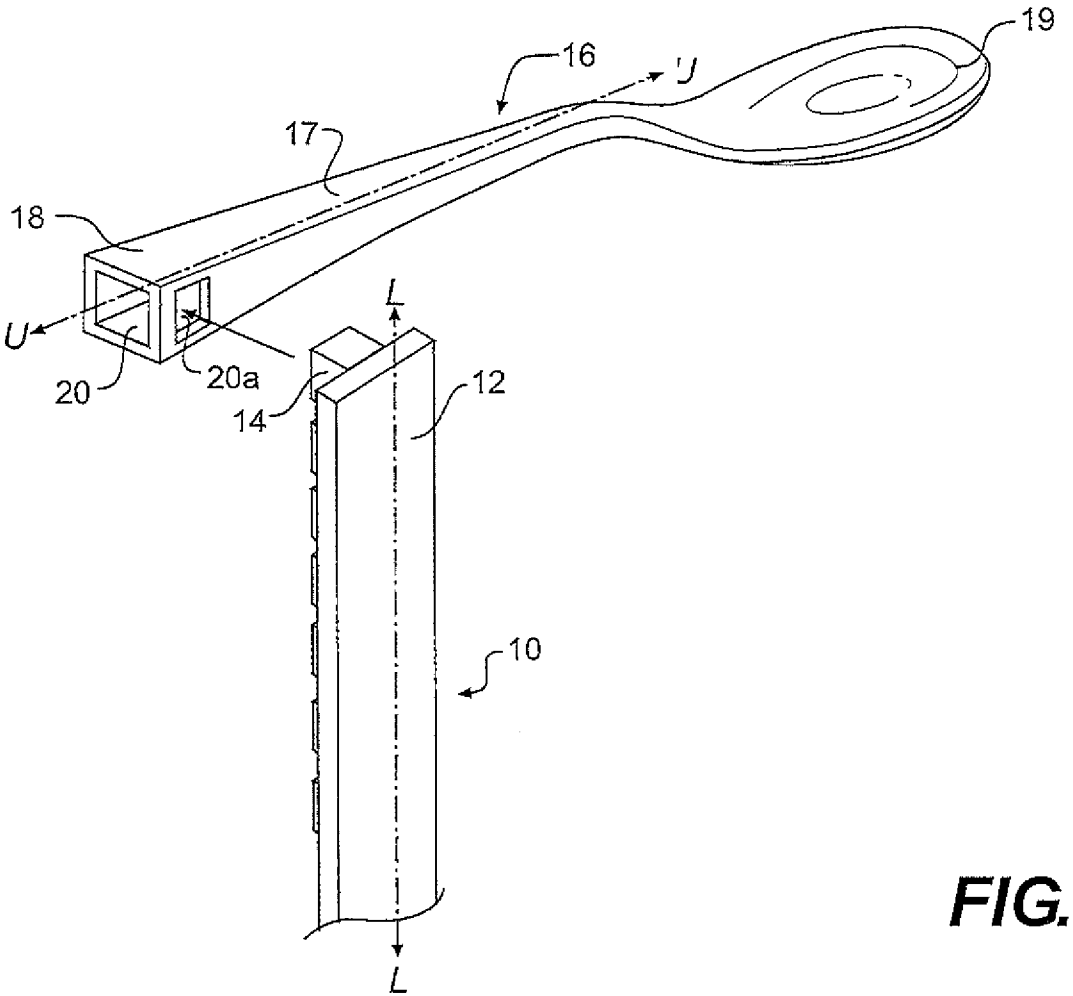
FIG. 2 is a schematic partial perspective view of an exemplary elongated apparatus and an exemplary utensil.

FIG. 2 shows an exemplary utensil 16 configured to be coupled to elongated apparatus 10 via movement in a direction that is not substantially parallel to utensil axis U. Utensil 16 shown in FIG. 2 includes a plurality of openings 20 that may be coupled with protrusions 14. As shown in FIG. 2, utensil 16 may be oriented such that protrusion 14 is capable of coupling with utensil 16 via the opening 20*a* provided on a lateral side of handle end 18. Upon coupling of handle end 18 to protrusion 14, utensil 16 is restricted from rotating about longitudinal axis L of elongated apparatus 10, so long as handle end 18 remains coupled to protrusion 14.

Figure 3:
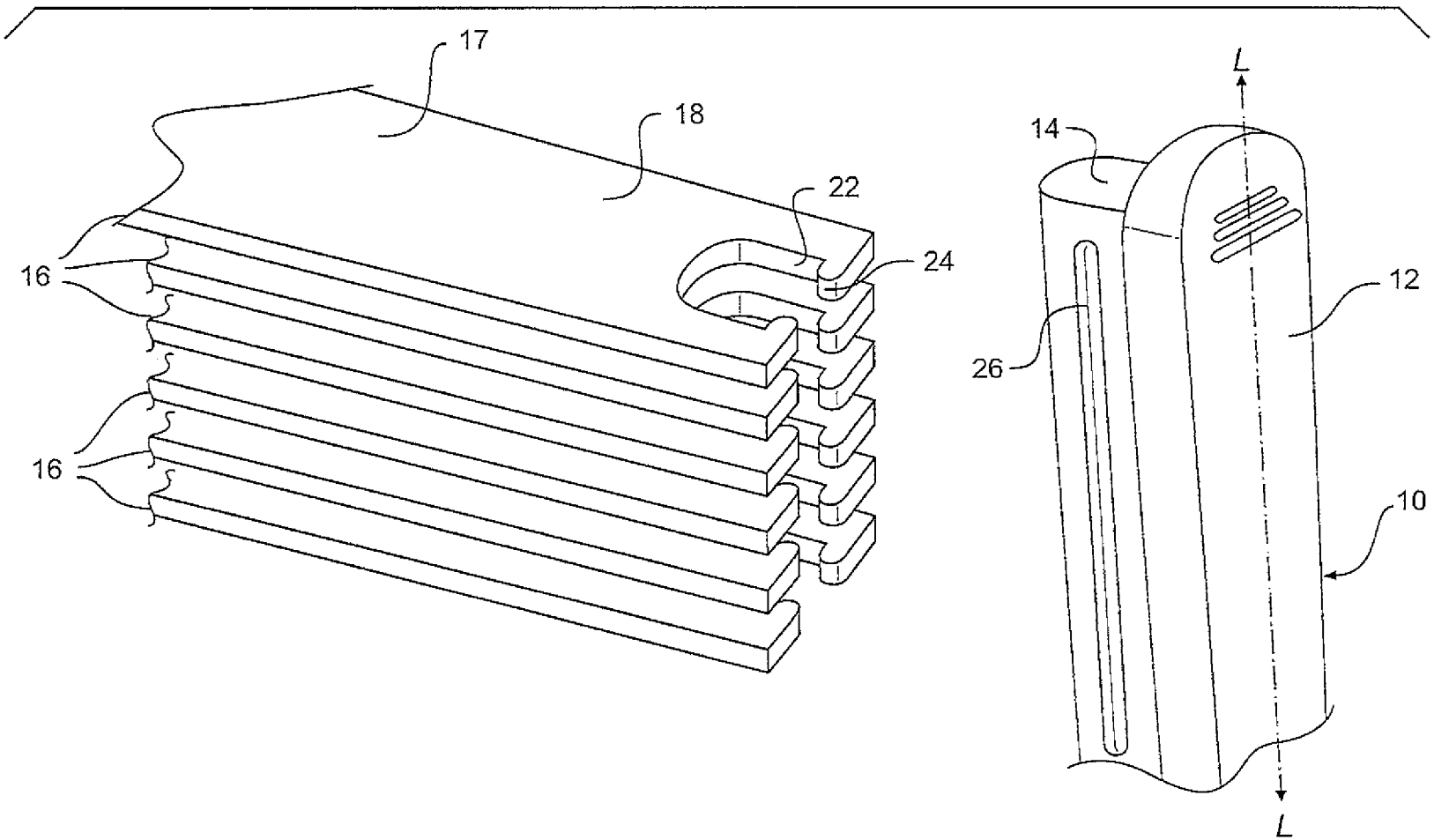
FIG. 3 is a schematic partial perspective view of an exemplary elongated apparatus and a plurality of exemplary utensils.

In addition to being removably coupled via an opening, some embodiments of utensil 16 may be configured to be removably coupled with elongated apparatus 10 via a slot. For example, FIG. 3 shows a schematic partial perspective view of a plurality of utensils 16 that include slots 22 configured to be removably coupled to protrusion 14 of elongated apparatus 10. In particular, slot 22 includes a narrow portion 24 configured to engage one or more features of protrusion 14. For example, protrusion 14 may have at least one ridge 26 provided on at least one surface of protrusion 14. According to the embodiment shown in FIG. 3, for example, protrusion 14 may have a ridge 26 on each side of protrusion 14 that extends along protrusion 14 in a direction substantially parallel to longitudinal axis L. Slot 22 of handle end 18 may engage protrusion 14 such that the narrow portion 24 of slot 22 engages ridge 26 and removably couples utensil 16 to elongated apparatus 10. According to some embodiments (not shown) protrusion 14 may have one or more ridges extending in a direction substantially perpendicular to longitudinal axis L. Such ridges may facilitate spacing between utensils on protrusion 14.

Similarly, in some embodiments, protrusion 14 may include a recess (not shown) instead of a ridge 26. In such an embodiment, narrow portion 24 may be configured to fit within the recess and removably couple utensil 16 to elongated apparatus 10. According to some embodiments, slot 22 may be configured to removably couple with protrusion 14 via movement of handle end 18 along an axis transverse to longitudinal axis L. Additionally, slot 22 may removably couple with protrusion 14 via movement of handle end 18 along an axis substantially parallel to longitudinal axis L.

Figure 4:
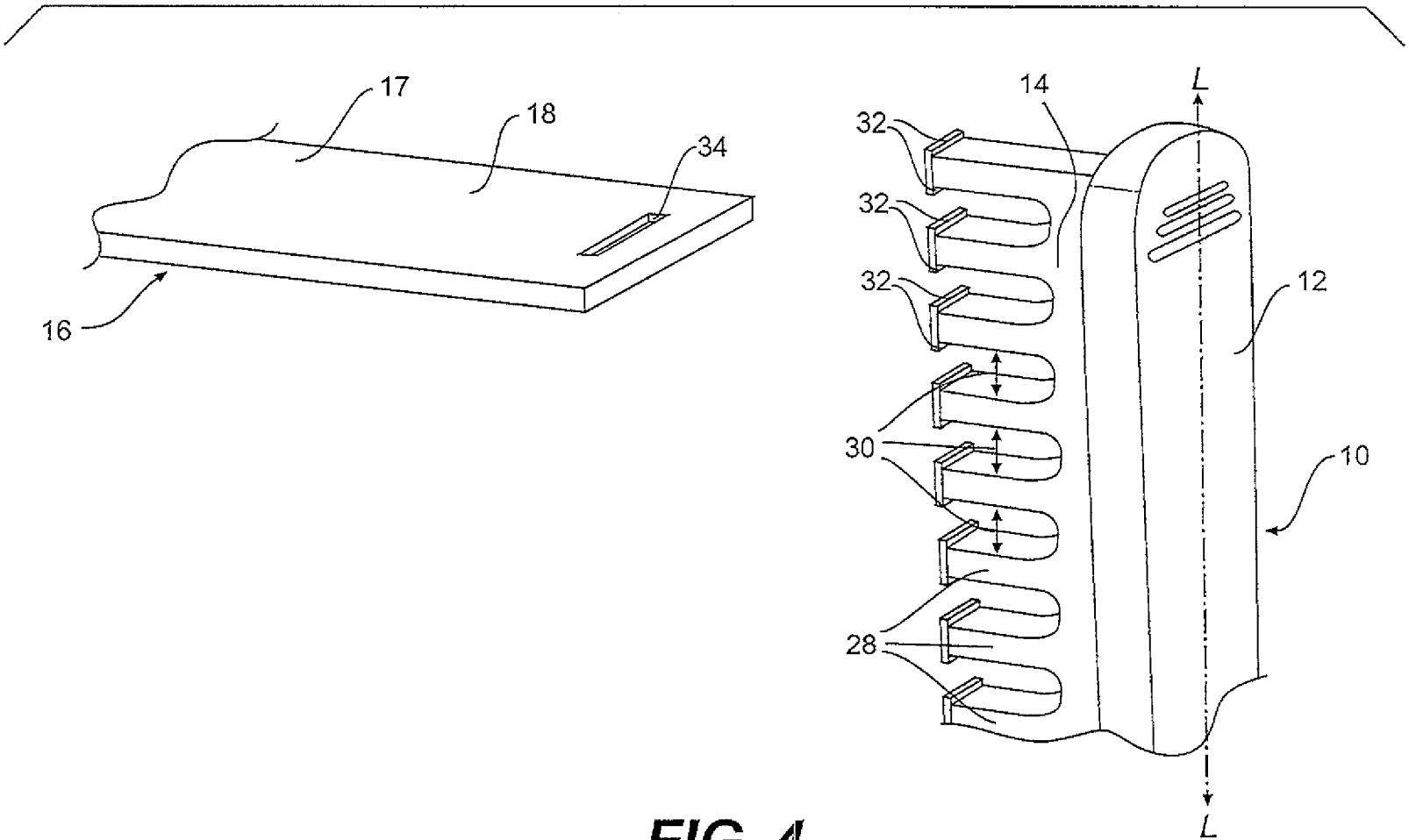
FIG. 4 is a schematic partial perspective view of an exemplary elongated apparatus and an exemplary utensil.

As shown in FIG. 4, elongated apparatus 10 may include at least one protrusion 14 that includes a plurality of peaks 28 configured to receive handle end 18. In some embodiments, for example, the peaks 28 may be shaped such that adjacent peaks 28 form a space 30 configured to receive handle end 18. At least one peak 28 may include at least one node 32 extending from the peak 28. Node 32 may be configured to engage an indentation 34 of handle end 18, such that utensil 16 is removably coupled to elongated apparatus 10. In some embodiments, handle end 18 includes at least one indentation 34 on a plurality of surfaces (e.g., on opposing surfaces) of handle end 18 configured to engage a plurality of nodes 32 simultaneously. Coupling may occur via movement of handle end 18 along an axis transverse to longitudinal axis L. In some embodiments, upon coupling of handle end 18 of utensil 16 to the peaks 28 of elongated apparatus 10, utensil 16 may be restricted from rotating about longitudinal axis L, so long as handle end 18 remains coupled to elongated apparatus 10.

In some embodiments, at least one protrusion 14 may be configured to separably couple utensil 16 to elongated apparatus 10 by receiving handle end 18 in a protrusion opening. The protrusion opening may at least partially surround at least a portion of handle end 18 and restrict utensil 16 from rotating about longitudinal axis L, so long as handle end 18 remains coupled to elongated apparatus 10.

Figure 5:
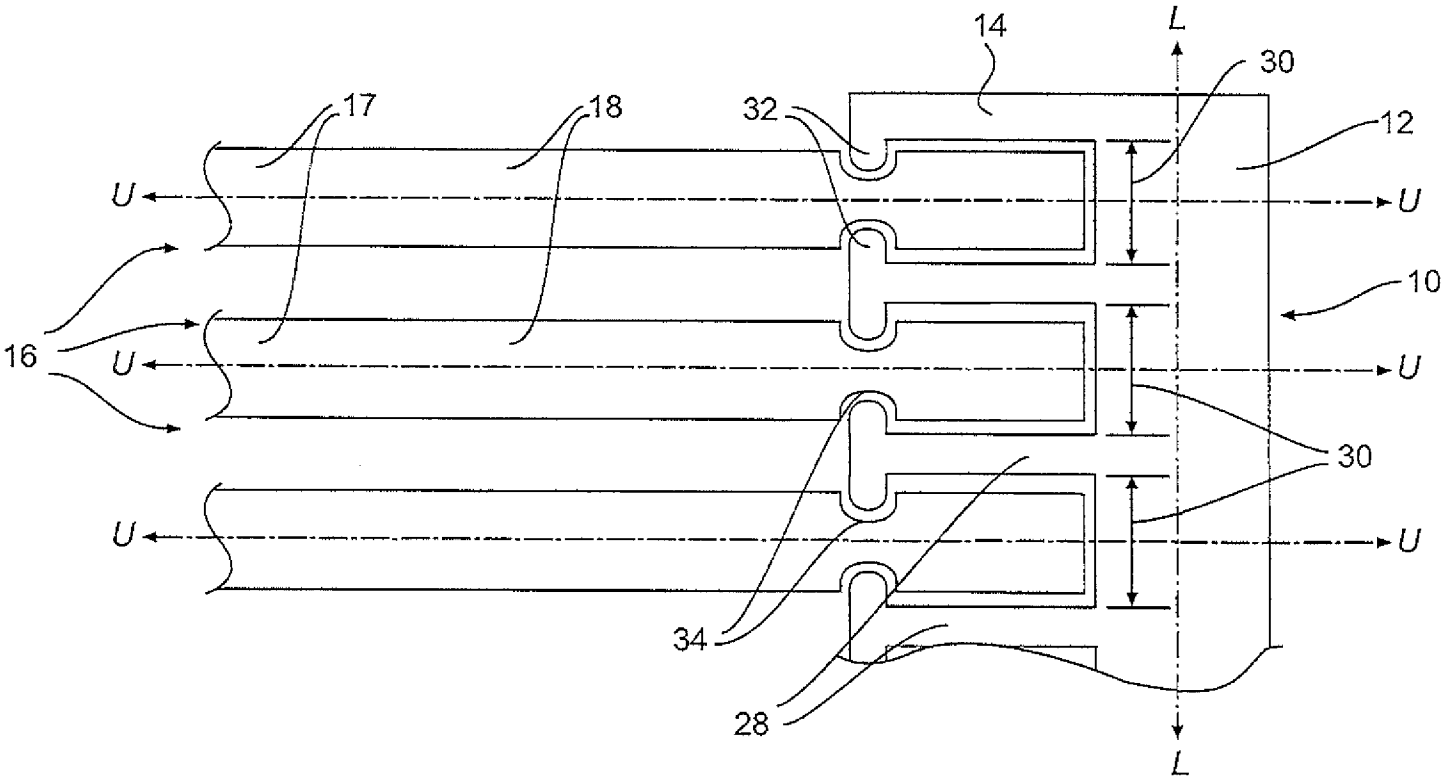
FIG. 5 is a schematic partial side view of an exemplary elongated apparatus and a plurality of exemplary utensils.

FIG. 5 shows a schematic partial side view of a plurality of exemplary utensils 16 separably coupled to an exemplary elongated apparatus 10. Each utensil 16 is shown coupled to elongated apparatus 10 via nodes 32 extending from peaks 28. Nodes 32 are coupled to the utensils 16 via opposing indentations 34 within handle ends 18.

In some embodiments, one or more inner surfaces within a handle end 18 include a recessed area configured to receive a ridge. For example, FIG. 6A shows a schematic partial perspective view of an exemplary protrusion 14 including a ridge 26 configured to engage at least one inner surface of handle end 18 of utensil 16.

Figure 6A:
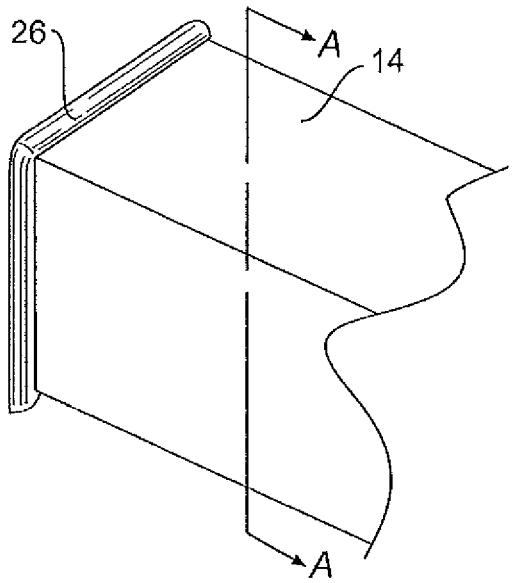
FIG. 6A is a schematic partial perspective view of an exemplary protrusion including an exemplary ridge.
Figure 6B:
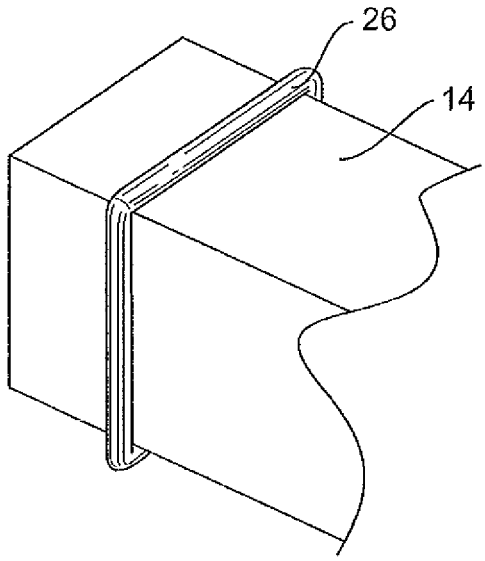
FIG. 6B is a schematic partial perspective view of an exemplary protrusion including an exemplary ridge.

While ridge 26 appears at the outer edge of protrusion 14 in FIG. 6A, it may be provided at other locations as well. For example, FIG. 6B shows protrusion 14 having an exemplary ridge 26 provided on a portion of at least two sides of protrusion 14 in a location other than the outer edge. According to some embodiments, depending on the location of ridge 26, protrusion 14 may be configured to separably couple to handle end 18 at various distances from elongated base 12. For example, when ridge 26 is located at the outer edge of protrusion 14, protrusion 14 may be able to engage handle end 18 without being fully inserted into opening 20. On the other hand, when ridge 26 is located closer to elongated base 12, it may be desirable to insert protrusion 14 further into opening 20 in order to engage handle end 18.

Figure 6C:
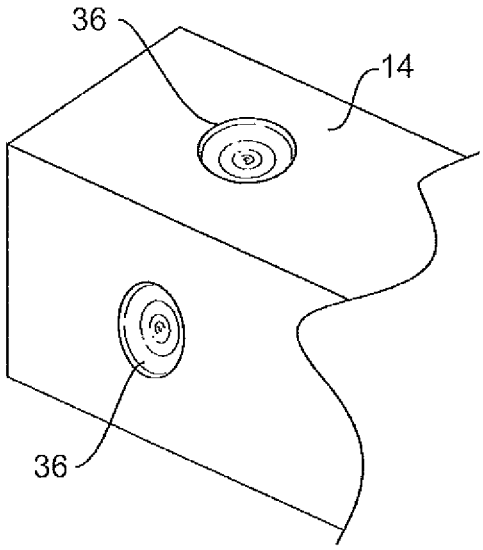
FIG. 6C is a schematic partial perspective view of an exemplary protrusion including a plurality of exemplary recesses.
Figure 6D:
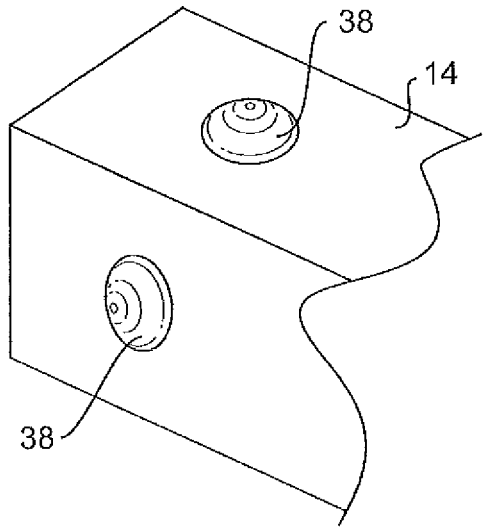
FIG. 6D is a schematic partial perspective view of an exemplary protrusion including a plurality of exemplary nodes.

According to some embodiments, one or more recesses may be substituted for ridge 26 shown in FIG. 6B. For example, such recesses may be configured to be separably coupled with at least one node (not shown) extending from an inner surface of opening 20. For example, FIG. 6C shows a schematic partial perspective view of a protrusion 14 including a plurality of recesses 36. Recesses 36 are shown have a substantially semi-spherical shape, but may be any shape, including, for example, rectangular or triangular. Alternatively, for example, as shown in FIG. 6D, protrusion 14 may include a plurality of nodes 38 configured to engage recesses located on the inner surface of opening 20.

Figure 7A:
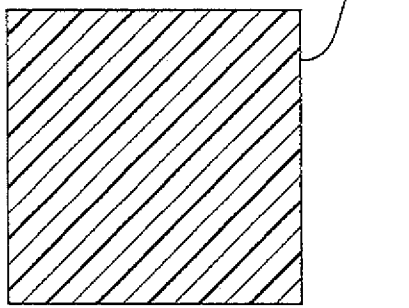
FIG. 7A is a schematic cross-sectional view along line A-A of FIG. 6A.

FIGS. 7A-7F show cross-sectional views of exemplary protrusions 14. For example, FIG. 7A shows a cross-section of the exemplary protrusion 14 shown in FIG. 6A along line A-A, with protrusion 14 having a solid rectangular cross-sectional shape. The protrusion 14 of FIG. 7A may be configured to couple with, for example, opening 20 of handle end 18 shown in FIG. 1 or 2. While protrusion 14 of FIG. 7A has a solid cross-sectional shape, protrusion 14 may also be hollow, as shown, for example, in FIG. 7B. According to some embodiments, protrusion 14 of FIG. 7B may be removably coupled to a handle end 18 that includes a solid cross-sectional shape. For example, handle end 18 may be solid with a portion of the handle end 18 shaped to engage the interior of the hollow portion of protrusion 14 of FIG. 7B.

Figure 7B:
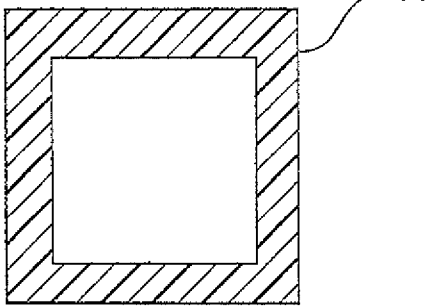
FIG. 7B is a schematic cross-sectional view similar to FIG. 7A for another exemplary protrusion.
Figure 7C:
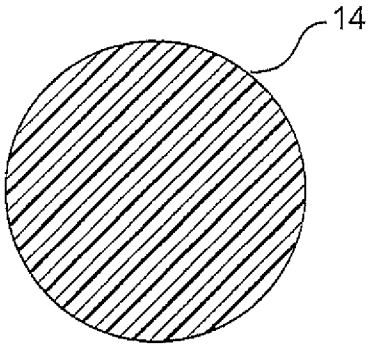
FIG. 7C is a schematic cross-sectional view similar to FIG. 7A for another exemplary protrusion.
Figure 7D:
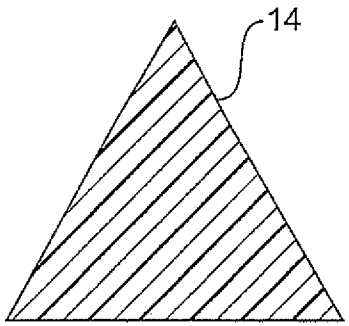
FIG. 7D is a schematic cross-sectional view similar to FIG. 7A for another exemplary protrusion.
Figure 7E:
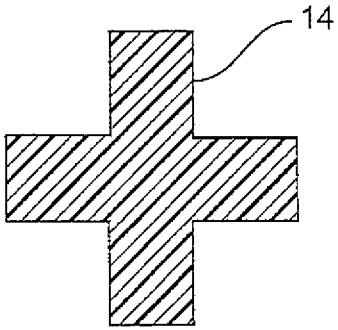
FIG. 7E is a schematic cross-sectional view similar to FIG. 7A for another exemplary protrusion.
Figure 7F:
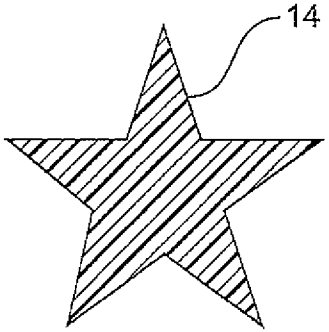
FIG. 7F is a schematic cross-sectional view similar to FIG. 7A for another exemplary protrusion.

Although FIGS. 7A and 7B show protrusions 14 having substantially rectangular cross-sectional shapes, it is contemplated that protrusions 14 may be provided in other cross-sectional shapes. For example, FIG. 7C shows a schematic cross-sectional view of a protrusion 14 that has a round cross-section. Although the protrusion 14 of FIG. 7C is shown having a solid cross section, it may also be hollow. FIG. 7D shows a schematic cross-sectional view of a protrusion 14 that has a triangular cross-section. According to some embodiments, protrusion 14 of FIG. 7D may be hollow. FIG. 7E shows a schematic cross-sectional view of an exemplary protrusion 14 that has a plus-shaped cross-section. FIG. 7F shows a schematic cross-sectional view of an exemplary protrusion 14 that has a star-shaped cross-section. The exemplary protrusions shown in FIGS. 7D-7F may have hollow cross-sections. Regardless of the cross-sectional shape of protrusion 14, opening 20 of handle end 18 may be shaped to separably couple with protrusion 14.

Figure 8A:
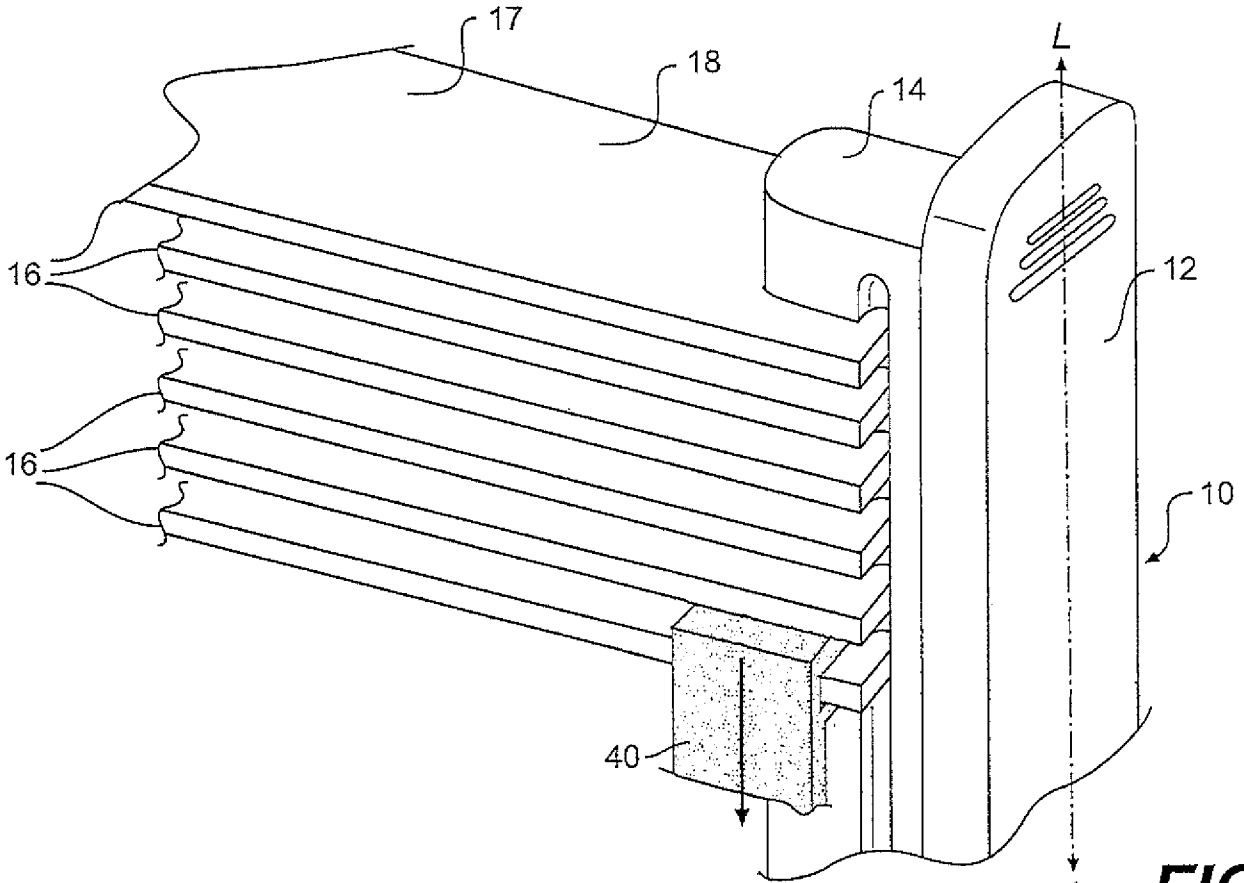
FIG. 8A is a schematic partial perspective view showing an exemplary decoupler decoupling an exemplary utensil from a plurality of grouped utensils.
Figure 8B:
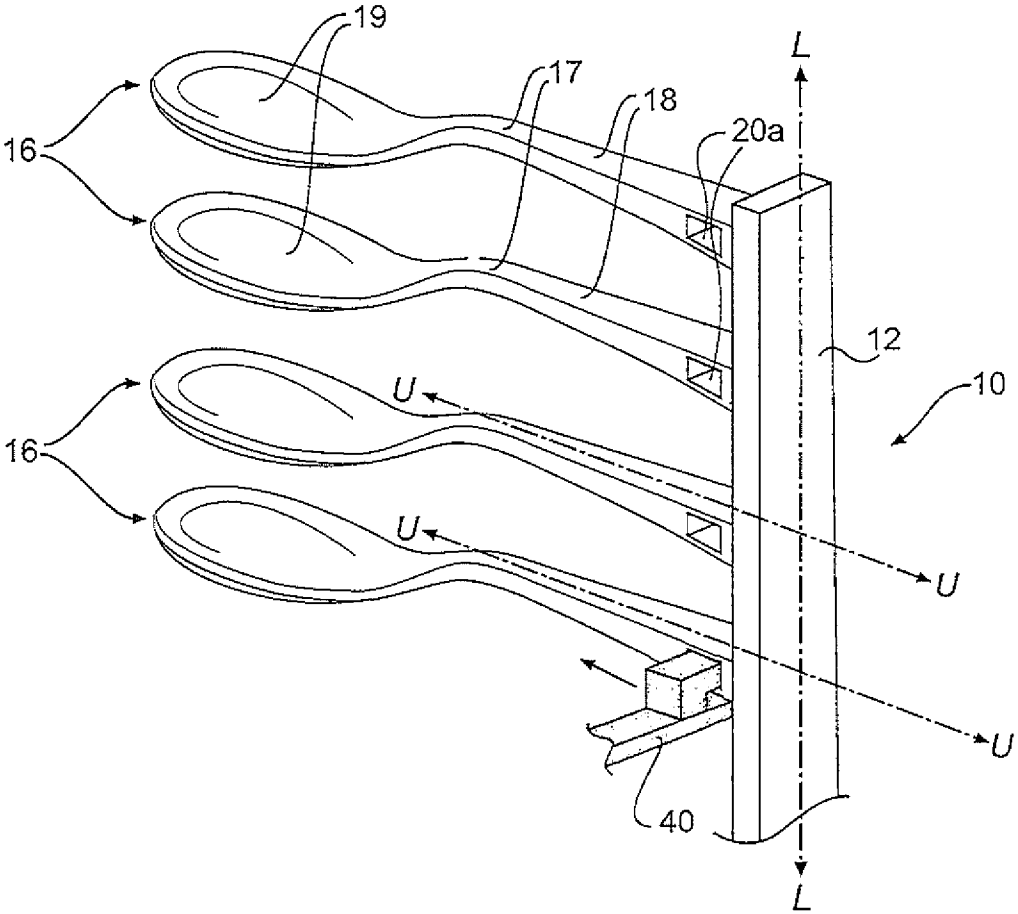
FIG. 8B is a schematic partial perspective view showing an exemplary decoupler decoupling an exemplary utensil from a plurality of grouped utensils.

FIGS. 8A and 8B show schematic perspective views of exemplary groups of separably coupled utensils 16 undergoing an exemplary decoupling and/or dispensing process. In FIG. 8A, for example, exemplary decoupler 40 is shown applying force to an exemplary utensil 16 in order to decouple utensil 16 from exemplary elongated apparatus 10. According to some embodiments, decoupler 40 may be configured to apply force to utensil 16 in a direction substantially parallel to longitudinal axis L, such that utensil 16 slides off protrusion 14, separating utensil 16 from protrusion 14. Such a decoupler 40 may have a claw- or clamp-shaped head, such that it abuts at least one surface of utensil 16. Alternatively, decoupler 40 may include a generally wedge-shaped head configured to be inserted between two utensils 16. For example, the size and/or shape of the head of decoupler 40 may force the utensils 16 on either side of the head in opposite directions, thereby separating at least one of the utensils 16 from elongated apparatus 10. According to some embodiments, decoupler 40 may separate utensil 16 from elongated apparatus 10 by severing at least a portion of one or more protrusions 14, with which utensil 16 is coupled.

In FIG. 8B, exemplary decoupler 40 is shown applying force to an exemplary utensil 16 in a direction substantially parallel to utensil axis U. By applying force in a direction substantially parallel to utensil axis U, decoupler 40 may separate utensil 16 from protrusion 14 without separating protrusion 14 from elongated apparatus 10. In some embodiments, however, exemplary decoupler 40 may apply a force to utensil 16 in a direction that separates at least a portion of at least one protrusion 14 from elongated apparatus 10. In the embodiment shown in FIG. 8B, exemplary decoupler 40 engages utensil 16 via at least one opening 20*a* in a lateral side of utensil 16.

It is contemplated that decoupling force may be applied to any number of utensils 16 in any number of directions. According to some embodiments, a plurality of decouplers 40 may be used individually, or in combination, to decouple utensils 16 from exemplary elongated apparatus 10. According to some embodiments, if at least one protrusion 14 is separated from elongated base 12, then protrusion 14 may remain inside handle end 18 or may be deposited into a receptacle for storage, recycling, or waste.

According to some embodiments, decoupler 40 may be part of a dispenser (not shown) for dispensing individual utensils 16. Such a dispenser may utilize a decoupler 40 to decouple utensils 16 either individually or in groups. The dispenser may also hold one or more types of utensils 16, including, for example, at least one of a spoon, a fork, a knife, and a spork.

In some embodiments, utensils 16 may be separated from elongated apparatus 10 without the use of decoupler 40. For example, elongated apparatus 10 may be removed by hand, for example, after utensils 16 have been loaded into a dispenser in a manner that will facilitate dispensing by the dispenser. For example, a grouping of a plurality of utensils 16 comprising elongated apparatus 10 may be loaded into a dispenser with elongated apparatus 10 coupled to the plurality of utensils 16. Once the plurality of utensils 16 is positioned in a desired manner in the dispenser, elongated apparatus 10 may remain in the dispenser during dispensing until the plurality of utensils 16 are depleted and prior to loading another grouping of utensils into the dispenser, or elongated apparatus 10 may be decoupled (e.g., by hand) from the plurality of utensils 16 once the utensils 16 have been loaded into the dispenser, but prior to dispensing any of the utensils 16.

It will be apparent to those skilled in the art that various modifications and variations can be made to the structures and methodologies described herein. Thus, it should be understood that the invention is not limited to the subject matter discussed in the description. Rather, the present disclosure is intended to cover modifications and variations.

What is claimed is:

1. An elongated apparatus for releasably retaining a plurality of cutlery utensils in a grouping, the apparatus comprising:

an elongated base having a longitudinal axis; and at least one protrusion extending from the elongated base, wherein the at least one protrusion comprises a ridge or a recess extending longitudinally in a direction substantially parallel to the longitudinal axis of the elongated base and configured to abut and removably couple a respective handle ends of a plurality of cutlery utensils to the at least one protrusion, wherein coupling of the handle ends of the cutlery utensils to the at least one protrusion occurs via movement of the handle ends along an axis transverse to the longitudinal axis of the elongated base, and wherein upon coupling of the handle ends of the cutlery utensils to the at least one protrusion, the cutlery utensils are is restricted from rotating about the longitudinal axis of the elongated base; wherein the one protrusion comprises a ridge or recess extending longitudinally substantially parallel to the longitudinal axis of the elongated base such that the respective handle ends of said plurality of cutlery utensils is configured to abut and removably couple to said protrusion and said ridge or recess.

2. The apparatus of claim 1, wherein the at least one protrusion comprises a ridge extending longitudinally in the direction substantially parallel to the longitudinal axis of the elongated base and configured to abut and removably couple the handle ends of the cutlery utensils to the at least one protrusion.

3. The apparatus of claim 1, wherein the at least one protrusion comprises a recess extending longitudinally in the direction substantially parallel to the longitudinal axis of the elongated base and configured to abut and removably couple the handle ends of the cutlery utensils to the at least one protrusion.

4. The apparatus of claim 1, wherein the at least one protrusion comprises a pair of ridges or a pair of recesses extending longitudinally along opposite sides of the at least one protrusion in the direction substantially parallel to the longitudinal axis of the elongated base and configured to abut and removably couple the handle ends of the cutlery utensils to the at least one protrusion.

5. The apparatus of claim 1, wherein the at least one protrusion comprises at least one of a rectangular-shaped, round-shaped, triangular-shaped, star-shaped, and plus-shaped cross-section.

6. The apparatus of claim 1, wherein coupling of the handle ends of the cutlery utensils occurs via movement of the handle ends along an axis perpendicular to the longitudinal axis of the elongated base.

7. A grouping of a plurality of cutlery utensils, comprising:

a plurality of cutlery utensils, at least one of the cutlery utensils each comprising:

a functional end; and a handle associated with the functional end, the handle having a handle end; and an elongated apparatus releasably retaining the plurality of cutlery utensils in the grouping, the elongated apparatus comprising:

an elongated base having a longitudinal axis; and at least one protrusion extending from the elongated base, wherein the protrusion comprises a ridge or a recess extending longitudinally in a direction substantially parallel to the longitudinal axis of the elongated base and abutting and removably coupling the handle ends of the cutlery utensils to the protrusion.

wherein the handle end of the at least one cutlery utensil is removably coupled to the elongated apparatus via the at least one protrusion such that a longitudinal axis of the at least one cutlery utensil extends in a direction transverse to the longitudinal axis of the elongated base.

8. The grouping of claim 7, wherein the at least one protrusion comprises a ridge extending longitudinally in the direction substantially parallel to the longitudinal axis of the elongated base and abutting and removably coupling the handle ends of the cutlery utensils to the protrusion, and wherein the handle end of the at least one cutlery utensil is removably coupled to the elongated apparatus via the ridge.

9. The grouping of claim 7, wherein the at least one protrusion comprises a recess extending longitudinally in the direction substantially parallel to the longitudinal axis of the elongated base and abutting and removably coupling the handle ends of the cutlery utensils to the protrusion, and wherein the handle end of the at least one cutlery utensil is removably coupled to the elongated apparatus via the recess.

10. The grouping of claim 7, wherein the handle ends of the at least one cutlery utensils each comprises a slot defined in a tip of the handle end, and wherein the slot removably engages the at least one protrusion by extending at least partially around the at least one protrusion.

11. The grouping of claim 10, wherein the at least one protrusion comprises a ridge extending longitudinally in the direction substantially parallel to the longitudinal axis of the elongated base and abutting and removably coupling the handle ends of the cutlery utensils to the protrusion, and wherein a narrow portion of the slot removably engages the ridge of the at least one protrusion.

12. The grouping of claim 10, wherein the at least one protrusion comprises a recess extending longitudinally in the direction substantially parallel to the longitudinal axis of the elongated base and abutting and removably coupling the handle ends of the cutlery utensils to the protrusion, and wherein a narrow portion of the slot removably engages the recess of the at least one protrusion.

13. The grouping of claim 7, wherein the at least one protrusion comprises at least one of a rectangular-shaped, round-shaped, triangular-shaped, star-shaped, and plus-shaped cross-section.

14. The grouping of claim 7, wherein the handle ends of the at least one cutlery utensils are is removably coupled to the elongated apparatus protrusion via movement in a direction substantially parallel to the a longitudinal axis of the at least one respective cutlery utensil.

15. The grouping of claim 7, wherein the handle ends of the at least one cutlery utensils are is removably coupled to the elongated apparatus protrusion via movement in a direction transverse to the a longitudinal axis of the at least one respective cutlery utensil.

16. The grouping of claim 15, wherein the handle ends of the at least one cutlery utensils are is removably coupled to the elongated apparatus protrusion via movement in a direction perpendicular to the longitudinal axis of the at least one respective cutlery utensil.

17. The grouping of claim 7, wherein the handle ends of the at least one cutlery utensils each comprises a slot, and wherein the slot removably engages the at least one protrusion.

18. The grouping of claim 7, wherein the at least one protrusion restricts the at least one cutlery utensils from rotating about the longitudinal axis of the elongated base.

19. The grouping of claim 7, wherein the at least one protrusion comprises a pair of ridges extending longitudinally along opposite sides of the at least one protrusion in a the direction substantially parallel to the longitudinal axis of the elongated base and abutting and removably coupling the handle ends of the cutlery utensils to the protrusion, and wherein the handle end of the at least one cutlery utensil is removably coupled to the elongated apparatus via the pair of ridges.

20. The grouping of claim 7, wherein the at least one protrusion comprises a pair of recesses extending longitudinally along opposite sides of the at least one protrusion in a the direction substantially parallel to the longitudinal axis of the elongated base and abutting and removably coupling the handle ends of the cutlery utensils to the protrusion, and wherein the handle end of the at least one cutlery utensil is removably coupled to the elongated apparatus via the pair of recesses.

* * * * *